US005366778A

United States Patent [19]

Johnson

[11] Patent Number: 5,366,778

[45] Date of Patent: Nov. 22, 1994

[54] WOVEN PAPERMAKERS FABRIC HAVING A UNIBODY SEAM AND METHOD FOR MAKING THE SAME

[75] Inventor: C. Barry Johnson, Summerville, S.C.

[73] Assignee: Asten Group, Inc., Charleston, S.C.

[21] Appl. No.: 951,311

[22] Filed: Sep. 24, 1992

Related U.S. Application Data

[63] Continuation of Ser. No. 775,047, Aug. 10, 1991, abandoned.

[51] Int. Cl.[5] ..... D21F 1/00; B32B 3/06

[52] U.S. Cl. ..... 428/58; 139/383 AA

[58] Field of Search ..... 428/58; 139/383 AA; 162/199, DIG. 1

[56] References Cited

U.S. PATENT DOCUMENTS

| | | | |
|---|---|---|---|
| 3,309,790 | 3/1967 | MacBean | 34/243 |
| 3,335,986 | 8/1967 | Cross | 245/10 |
| 3,622,415 | 11/1971 | Kunsman | 156/158 |
| 4,090,897 | 5/1978 | Minick | 156/73.1 |
| 4,658,863 | 4/1987 | Errecart | 139/383 AA |
| 4,911,683 | 3/1990 | Legge et al. | 474/255 |
| 4,938,269 | 7/1990 | Nicholas et al. | 428/58 |
| 5,092,373 | 3/1992 | Lee | 139/383 AA |

FOREIGN PATENT DOCUMENTS

| | | | |
|---|---|---|---|
| 0341041 | 11/1989 | European Pat. Off. | D21F 1/00 |
| 1520478 | 4/1968 | France | 139/383 AA |
| 1259287 | 12/1991 | United Kingdom . | |
| 9119044 | 12/1967 | WIPO . | |

OTHER PUBLICATIONS

PCT International Search Report, Feb. 22, 1993.

*Primary Examiner*—Alexander S. Thomas
*Attorney, Agent, or Firm*—Volpe and Koenig

[57] ABSTRACT

An endless papermakers belt which is formed from a length of woven fabrics having its ends joined together to form the endless belt. The fabric has joining loops at each end of the fabric which are formed entirely from and are a linear continuation of the original woven fabric.

5 Claims, 4 Drawing Sheets

WOVEN PAPERMAKERS FABRIC HAVING A UNIBODY SEAM AND METHOD FOR MAKING THE SAME

CROSS-REFERENCE TO RELATED APPLICATIONS

This application is a continuation of U.S. patent application No. 07/775,047, filed Aug. 10, 1991 now abandoned.

BACKGROUND OF THE INVENTION

1. Field of the Invention

The present invention relates generally to the joining of woven fabrics to render them endless. More particularly, the invention related to joining papermakers to render them as an endless belt on the papermaking equipment. Most particularly, the present invention relates to joining woven papermakers dryer fabrics by interleaving complementary projections and recesses on each end of the fabric and inserting a retaining means into a channel formed in the cross machine direction.

2. Description of the Prior Art

It is known to join woven fabrics in order to render them endless. Likewise, it has been known to join woven fabrics through the use of complementary projections and recesses which are interleaved to define a channel into which a retaining means is inserted. As will be appreciated by those skilled in the art, the prior art has developed a number of techniques for producing the complementary projections and recesses which are interleaved and a number of techniques for producing the cross machine direction channel(s) into which the retaining means is/are inserted. It has been recognized by the art that the join area should, to the extent possible, duplicate the weave pattern, caliper, permeability and interstice configuration of the fabric. Efforts to accomplish such a seam configuration have produced techniques in which yarns are woven back into the fabric in an effort to create complementary ends having a substantially uniform construction with that of the remainder of fabric. In addition, techniques have been developed for folding the end of the fabric back and forming interleaving projections.

In all of the known prior art techniques, the process may be labor intensive and/or produce a seam which does not have the same caliper as the remainder of the fabric or does not share other fabric characteristics with the remainder of the fabric.

As a result of the above, efforts were undertaken to produce a join area which, except for the retaining means, was formed entirely from the fabric as woven. In addition, the efforts were directed toward preserving the fabric construction, caliper and operating characteristics throughout the seam area. Still further, it was concluded that the desired seam would not require a doubling or folding back of the fabric end.

SUMMARY OF THE INVENTION

The present invention provides an endless papermakers felt which is formed from a length of woven fabric and has its ends joined to form the endless belt. The endless belt is characterized by joining means which are formed at each end of the fabric without the addition of any materials to the weave. In other words, the joining means are formed entirely from the yarns which are part of the woven fabric and, as formed, are a linear continuation of the original woven fabric. The joined area maintains all of the woven characteristics of the fabric and is substantially identical to the remainder of the fabric.

In addition to the above, the present invention provides a method for producing the fabric. In the method of the invention, each end of the woven fabric is trimmed to establish a maximum fabric length and to provide a true cross machine direction edge on each end of the fabric. Each cross machine direction edge is parallel to the last cross machine direction yarn on the respective edge. After formation of the edge of the fabric with a true cut, at least one cross machine direction yarn is removed from each end of the fabric. The removed yarns are positioned at least one cross machine direction yarn from the respective fabric edge and create a cross machine direction void on the respective fabric edge. A plurality of alternating projections and recesses are formed on each end of the fabric. The alternating projections and recesses are formed on the respective ends so that they will complement each other and the cross machine direction void at each respective end is at substantially the same distance from the respective edge. The projections and recesses are interleaved to form an uninterrupted linear continuation of the original woven fabric and to align the cross machine direction voids. After the voids have been aligned, retaining means are inserted in the cross machine direction to render the fabric endless.

DESCRIPTION OF THE PREFERRED EMBODIMENT

This description of the preferred embodiment will be made with reference to the attached drawings and like elements are identified by the same numeral throughout. In describing the preferred embodiment, the illustrative fabric is a flat woven fabric which is more fully described in U.S. patent application Ser. No. 07/534,164 which was filed on Jun. 6, 1990 and is assigned to a common assignee. It will be understood by those skilled in the art that the fabric weave is illustrative and does not form a limitation of the present invention. Likewise, it will be understood by those skilled in the art, after a full review of the description set forth hereinafter, that the fabric must be comprised of bondable or thermoplastic yarns.

Figure 1:
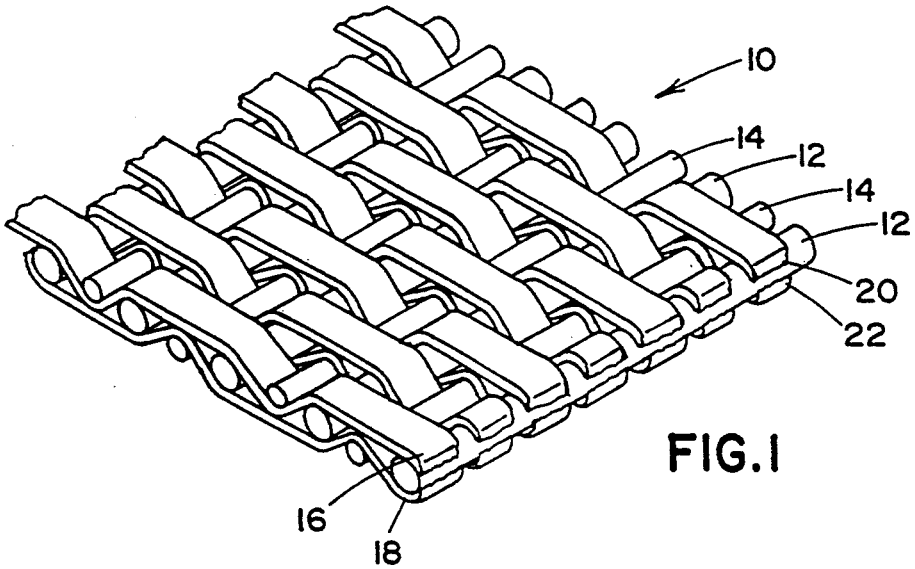
FIG. 1 is a perspective view of a section of woven fabric prior to its preparation in accordance with the invention.

Turning to FIG. 1, the fabric is constructed of synthetic, thermoplastic monofilament yarns. In the illustrated configuration, the upper machine direction yarns 16 and the lower machine direction yarns 18 have a non-circular or flattened profile. The machine direction yarns are woven so that paired upper and lower yarns are stacked in the same relative vertical alignment throughout the body of the fabric. The cross machine direction yarns system is comprised of alternating yarns 12 and 14. As illustrated in FIG. 1, the cross machine direction yarn 14 is of a smaller diameter than cross machine direction yarn 12. As a result, the caliper of the fabric is substantially consistent throughout its length despite the fact that the machine direction yarns 16 and 18 both interweave at the same position with yarn 14. By way of example, the cross machine direction yarn 12 may be about 0.8 mm and the cross machine direction 14 may be about 0.6 mm.

Figure 2:
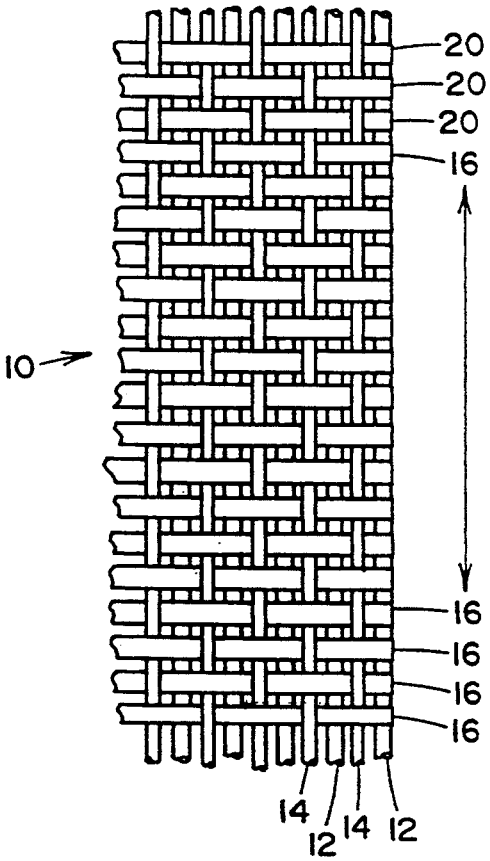
FIG. 2 is a top plan view of a section of fabric as illustrated in FIG. 1.

With reference to FIGS. 1 and 2, the preparation of the ends of the fabric will be discussed in more detail. As will be appreciated by those skilled in the art, the drawing figures represent a portion of the weave for the sake of clarity. The actual fabric will have a length that is at least as long as the maximum length of the desired finished fabric. Each end of the fabric length will be prepared in a similar fashion. Accordingly, the discussion of one fabric end will apply equally to that of the other fabric end, unless otherwise described. As shown in FIGS. 1 and 2, the fabric has been trimmed so as to establish the maximum length of the fabric and to provide a cross machine direction edge which is parallel to the last cross machine direction yarn 12. In the present construction, it is preferred to trim the fabric in this manner since the cross machine direction yarn 12 is in direct contact with the machine direction yarns from both the upper and lower systems. However, if desired, the fabric could be trimmed parallel to the cross machine direction yarn 14. As shown in FIGS. 1 and 2, the thermoplastic nature of the machine direction yarns will result in the formation of a bond areas as shown at 20 and 22. With reference to FIG. 2, the bond areas will continue along the cross machine direction edge of the fabric and will bond each of the machine direction yarns 16 and 18 to the same cross machine direction yarn 12. The apparatus and method for preparing the end of the fabric as shown in FIGS. 1 and 2 will be described hereinafter.

Figure 3:
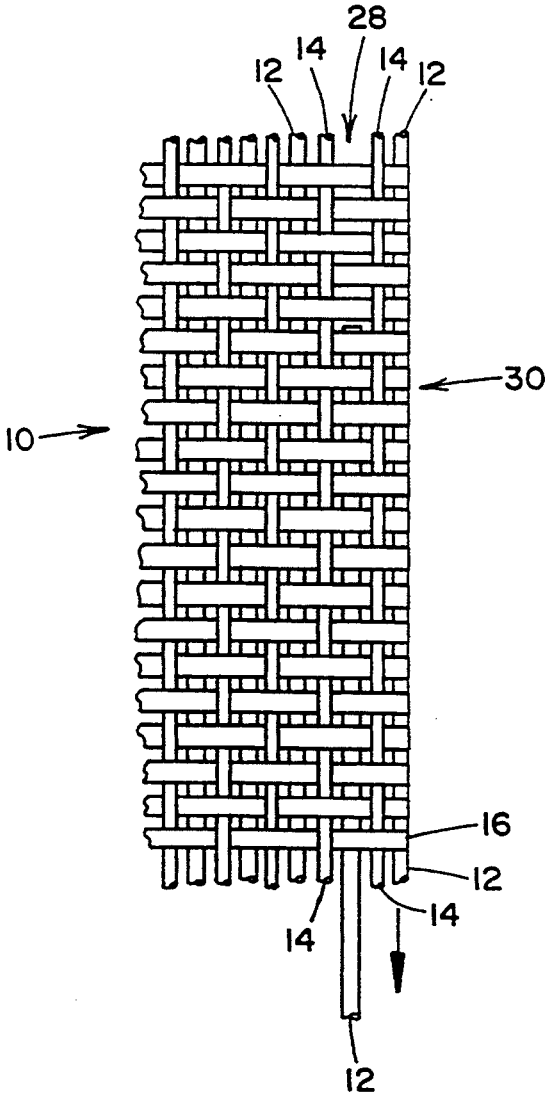
FIG. 3 is a top plan view similar to that of FIG. 2 and shows the removal of a cross machine direction yarn.

With reference to FIG. 3, the description of seam formation will be continued. After the fabric has been true cut, at least one cross machine direction yarn is removed from each end of the fabric. The removal of the cross machine direction yarn results in the creation of a cross machine direction void. In the present fabric construction, it is preferred that one of the larger cross machine direction yarns 12 be the removed yarn. In addition, it is preferred that the removed yarn be spaced from the cross machine direction edge of the fabric by at least one cross machine direction yarn.

It will be appreciated by those skilled in the art that the cross machine direction yarn may be removed prior to forming the cross machine direction edge. However, it is presently believed that the additional stabilization which results from formation of the cross machined direction edge will facilitate the removal of the yarn and will help to stabilize the fabric during yarn removal.

Figure 4:
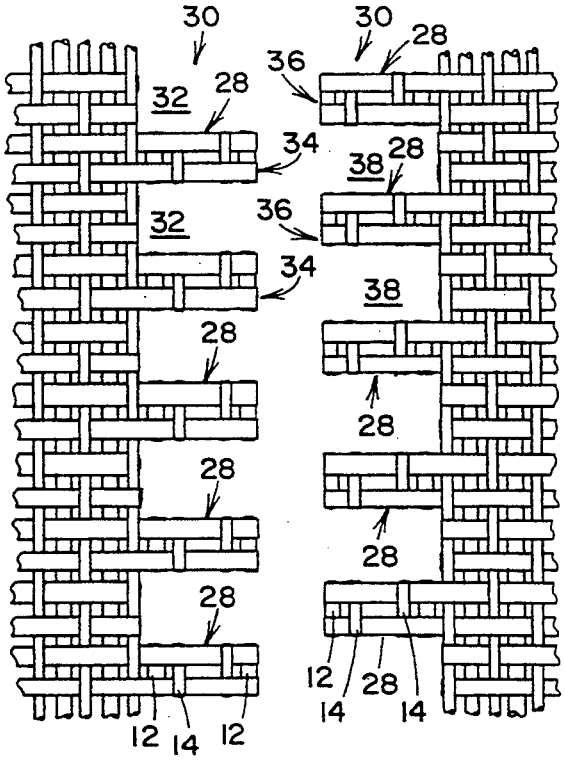
FIG. 4 is a top plan view of a fabric according to the present invention prior to being joined and retained as an endless fabric.

Referring to FIG. 4, there is illustrated the ends 30 of the fabric prior to interleaving in order to form the endless fabric. Although each end of the fabric is identified as 30, the projections and recesses on the opposed ends of the fabrics have been identified by different numerals in the interest of clarity. As can be seen from FIG. 4, the recesses 32 will be positioned opposite the projections 36. Likewise, the recesses 38 which alternate with the projections 36 will be positioned opposite the projections 34 which alternate with the recesses 32. This manner of interleaving is well known in the art. When the two fabric have been interleaved, the cross machine direction voids 28 will be aligned. Likewise, the cross machine direction yarn segments 12 and 14 from each of the respective ends will be aligned.

Figure 5:
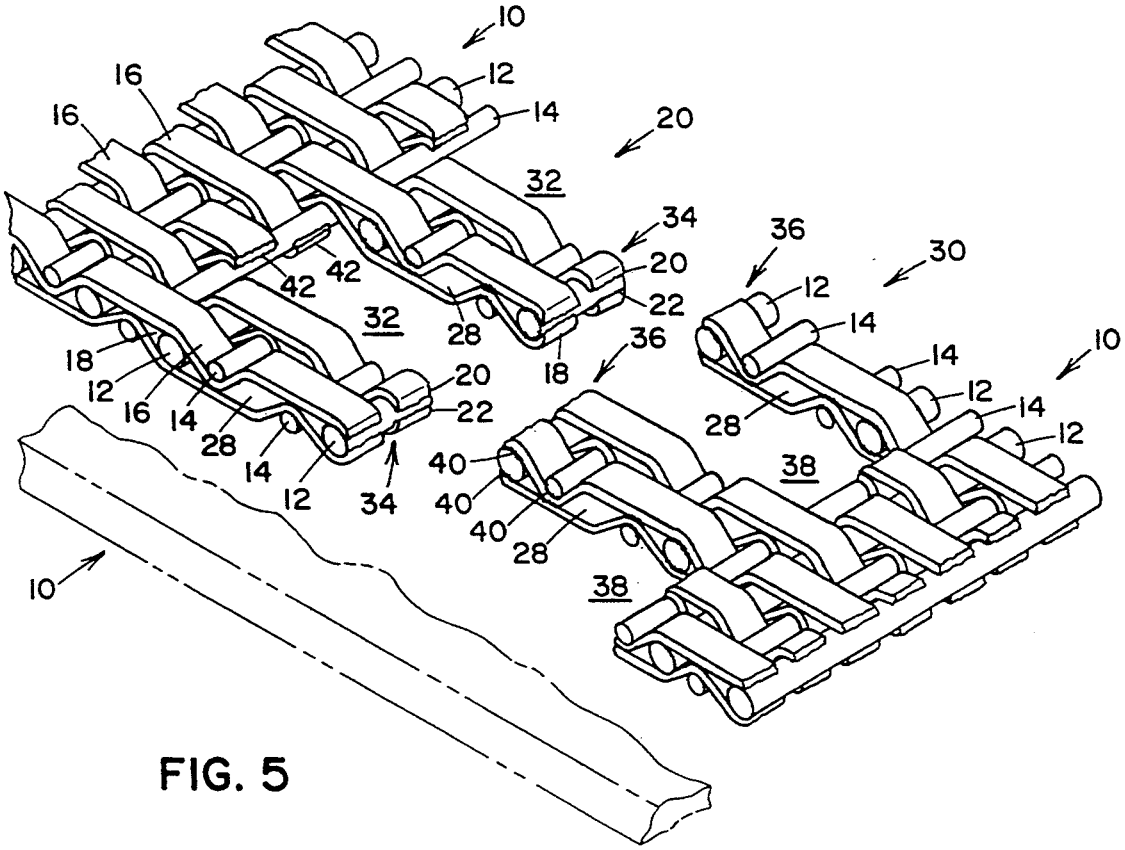
FIG. 5 is a perspective illustration of the fabric as shown in FIG. 4.

With reference to FIG. 5, there is shown a partial orthographic view of the fabric prior to interleaving. Also shown in FIG. 5, in a schematic manner, is the remaining portion of the fabric which will extend from each of the portions. Since those skilled in the art will understand that the weave continues throughout the body of the fabric, there is no need to illustrate the full weave pattern as it extends throughout the fabric. As can be seen from FIG. 5, the cross machine direction voids 28 will be spaced from the cross machine direction edge of the fabric by one cross machine direction yarn 14 and one cross machine direction yarn 12. Likewise, the cross machine direction voids 28 will be spaced in the center of the recesses 32 and 34. Accordingly, each of the projections will include a cross machine direction yarn 12 and 14 on either side of the cross machine direction voids 28.

As can be seen from FIG. 5, the thermoplastic nature of the yarns will result in material bond between the machine direction yarns 16 and 18 and the cross machine direction yarns 12 and 14. This is generally illustrated by the numeral 40 in FIG. 5. It will be appreciated by those skilled in the art that this bonding is localized and that it will not produce deformation in the fabric construction or interference with the projections and recess. As explained in more detail hereinafter, current techniques for producing the fabric will permit the formation of the projections and recesses within very close tolerances. In addition to the machine direction edge bonding which is illustrated at 40, there is additional cross machine direction bonding which takes place between the cross machine direction yarn and the machine direction yarns as illustrated at 42. As can be seen in the illustration of FIG. 5, the machine direction yarns 16 and 18 are weaving on the same side of the cross machine direction yarn 14 in the illustration of FIG. 5. Due to the illustrated weave construction, both of the machine direction yarns will be bonded on the same side of the cross machine yarn 14.

Figure 6:
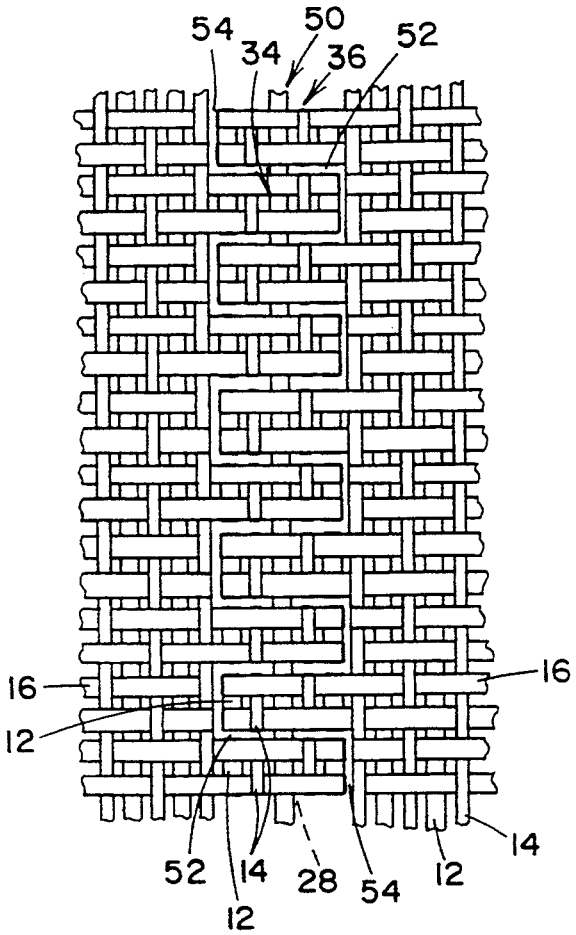
FIG. 6 is a top plan view illustrating the fabric in its joined configuration.
Figure 12:
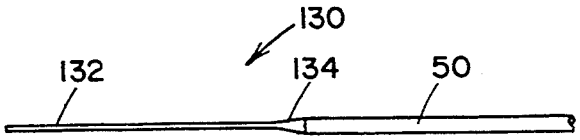
FIG. 12 illustrates one suitable retainer means for joining the fabric.

Referring now to FIG. 6, a top plan partial view of the assembled fabric, assembly of the seam will be discussed. As noted previously, the projections 34 and 36 are interleaved to align the cross machine direction voids 28. After alignment, retaining means 50 is inserted into the cross machine direction void and the fabric is rendered endless. The use of such a pintle 50 will be well known to those skilled in the art. It will also be recognized by those skilled in the art that pintle 50 should be selected to compliment the fabric weave. It is also known to use a metal lead wire to insert and guide the pintle 50 into the void. In the present application, the use of such a lead wire has been found to be of particular advantage. Although the cross machine direction voids 28 are generally undisturbed by the processing of the fabric, it is possible to experience small variations in the void due to material flow or realignment. Accordingly, the use of a thin lead wire will permit an easy insertion. In addition, the use of a conical or funnel like ferrule to connect the lead wire and the pintle will further assist insertion of the pintle. The geometry of one acceptable pintle is shown in FIG. 12.

Still with reference to FIG. 6, it can be seen that the machine direction yarns 16 are aligned in the seam area. Although not visible in this view, the machine direction yarns 18 are also aligned. Likewise, the cross machine direction yarns 12 and 14 are aligned in the seam area. As noted previously, pintle 50 is approximately the same size as cross machine direction yarn 12. As can be seen from an examination of the seam area, it will have the same repeat characteristics as the remainder of the fabric. However, the seam area will have machine direction gaps between the projections 34 and 36. It will be obvious to those skilled in the art that the machine direction gaps 52 result from the removal of the cross machine direction yarn segments during preparation of the fabric ends. Likewise, the cross machine direction gaps 54 result from the removal of machine direction yarn segments during formation of the recesses. It will be appreciated by those skilled in the art that the gaps between the projections 34 and 36 will vary with the fabric weave and FIG. 6 is only illustrative of the resulting configuration. Likewise, it will be appreciated that the gaps 52 and 54 maybe beneficial since they permit free movement of the yarn without interference between and among the bonding points 20, 22, 40 and 42.

With reference to FIGS. 5 and 6, it can be seen that the endless fabric will have the same continuous weave pattern throughout its length, that the caliper of the fabric will not be altered, that the joining means at each end of the fabric are formed entirely from and are a linear continuation of the original woven fabric and that there are no elements added to the fabric as part of the formation of the joining means. The insertion of a pintle as a joining expedient is a substitution for the removed cross machine direction yarn. If so desired, one of the removed cross machine direction yarns may be reinserted as the pintle. At present, the use of a pintle 50 is preferred.

With references to FIGS. 6 through 11, the formation of the projections and recesses will be more fully described. It will be appreciated by those skilled in the art that I prefer to establish a regular cross machine direction edge on each end of the fabric 10. At present, the formation of these preliminary edges is achieved by selecting a cross machine direction yarn, marking that yarn and then cutting the fabric parallel to that yarn. The cut may be either purely mechanical or a mechanical cut aided by heat or a thermal cut such as by ultrasonics or lasers. After the initial cut on each end has established the reference cross machine direction yarn, the fabric is prepared for the establishment of a true cross machine direction cut on each end.

Figure 7:
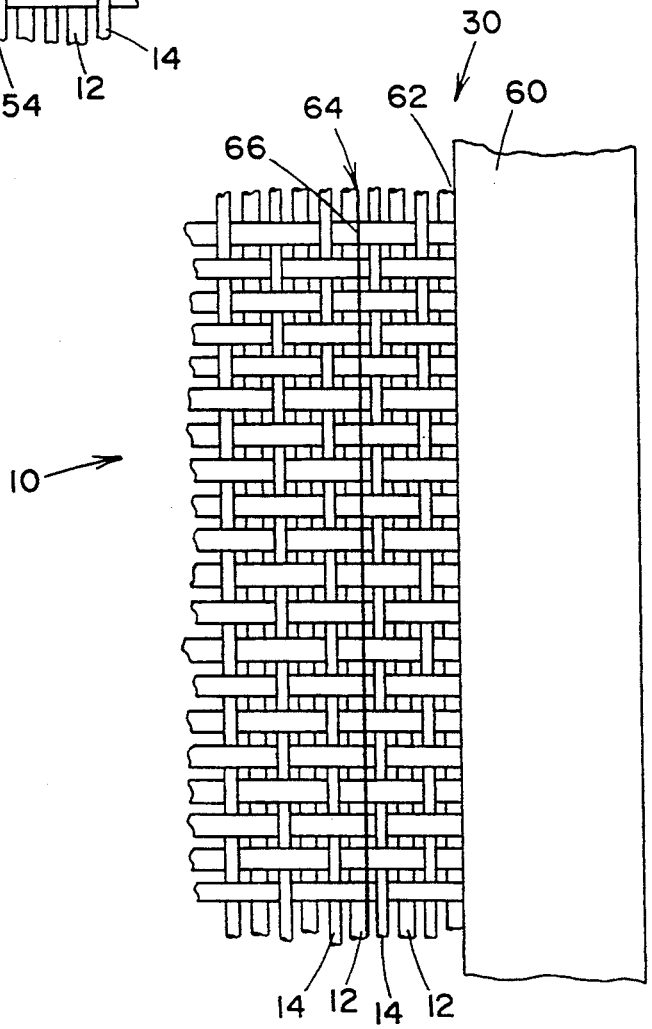
FIG. 7 is a top plan view illustrating the fabric in position for the formation of a true cut.

In order to establish the spacing and desired yarn orientation, the fabric 10 is presented to a cutting table. As shown in FIG. 7, the previously trimmed fabric is presented against the side of a bar 60 which establishes a cross machine direction reference point. At that point, a cross machine direction yarn is selected as the location of the true cut. The fabric 10 is marked, 64, along that cross machine direction yarn. The cross machine direction marking 64 will become the true cut. The true cut may be made by means of a laser which is optically guided along the marking 64 or by other means such as a sharp hot knife or the like. In any event, it is preferred that the true cut be accomplished by a means which includes the generation of heat which is sufficient to cause a softening or flow of the material without a deformation thereof. As will be appreciated by those skilled in the art, the desired temperature will vary according to the selected yarn materials. In any event, the cut must be a clean cut which will establish a cross machine direction edge which is parallel to the last cross machine direction yarn. If the yarns are not maintained parallel to each other, it is very possible that the final formation of the projections 32 and 34 will result in irregular alignment of the yarns when they are interleaved and pintled.

Figure 11:
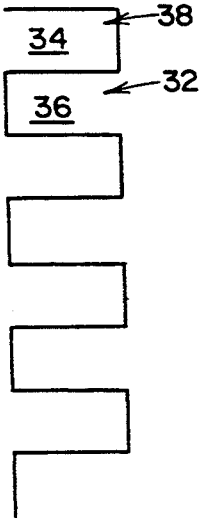
FIG. 11 illustrates one potential pattern for preparing the fabric ends in accordance with the present invention.

At present, the preferred technique for establishing the fabric end 64 is a laser cut under computer control. With reference to FIG. 11, there is illustrated a pattern which may be followed by the computer in accomplishing the desired cuts. By using a single control pattern and two independently operating cutting means the laser will control the cutting means so as to make the recesses and projections at the same time. For straight line cutting a single straight line pattern will still control both cuts. This should aid in creating uniformity of cut and match.

Figure 8:
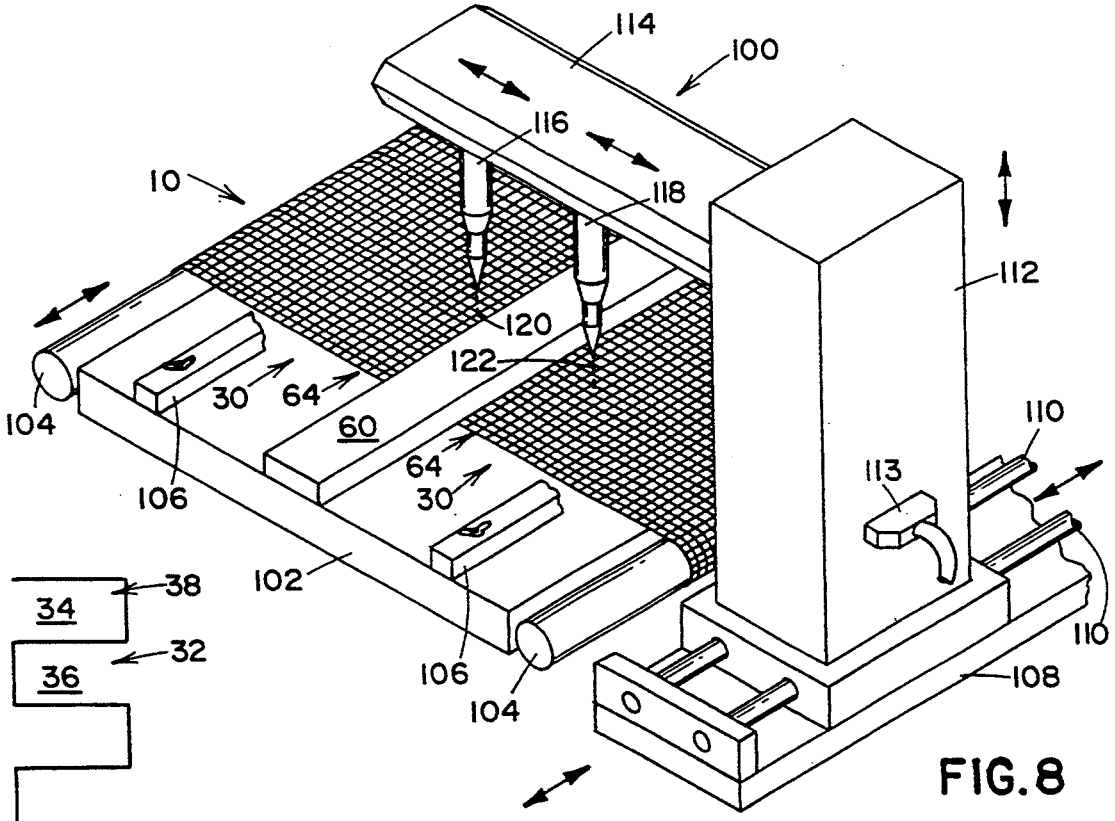
FIG. 8 illustrates one device for forming the fabric ends in accordance with the present invention.

Turning now to FIG. 8, there is shown a computer controlled laser cutting apparatus 100 which will accomplish both the true cut edges and the formation of the opposed projections and recesses. The apparatus 100 has a fabric support table 102 and fabric positioning rolls 104 which assist in addressing the fabric around the table. Each end of the fabric is addressed to a side of the bar 60. Bar 60 extends across the table, which is preferably of a width greater than the width of the fabric, and provides a true edge. The fabric is positioned against the bar and the true cut marking 64 is established along the cross machine direction yarn. The fabric is held in position by clamps 106. The clamps 106 are spaced from the bar 60 by a sufficient distance to permit easy operation in the seaming area while relieving the seam area from tension which is associated with the weight of the fabric hanging over the rollers 104. The true cut edge 64 may be accomplished in a number of ways. One way to accomplish the edge cut is to position the laser guns 116 and 118 with the respective cutting points 120 and 122 on the true cut marks 64. The lasers may be guided by a pattern or may be optically guided along the marks 64 as they traverse the cross machine direction.

As can be seen from FIG. 8, the laser cutting tools depend from the arm 114 and are adjustable with respect to the positioning of the cutting point 120 or 122 as shown by the arrows on arm 114. The arm 114 is adjustable in the vertical plane as indicated by the arrows adjacent housing 112. Housing 112 supports the arm 114 and encases the control means for generating the laser beams and positioning the lasers. The movement of housing 112 is controlled by a computer in accordance with the fabric design parameters. The control output from the computer is applied via the input 113 to the control housing 112. In light of the various fabric constructions, it is believed that computer control will provide more variability with respect to meeting the various fabric configurations. The cutting apparatus 100 is mounted on a pair of rails 110 which are of equal length with the table. This will permit the cutting apparatus to continue its movement in the cross machine direction and thereby avoid the possibility of introducing errors by stopping the cutting operation or moving the fabric. It will be appreciated by those skilled in the art that the table 102 and the cutting apparatus will be suitably mounted for stability. However, the embodiment shown in FIG. 8 includes a moveable arm 108 which is intended to swing away from the table 102 and to permit free access to the fabric as a means of improving the alignment operation.

Figure 10:
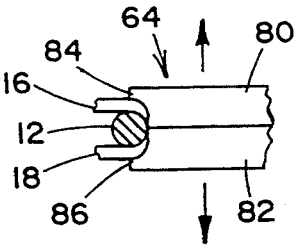
FIG. 10 illustrates a non-rotary device for preparing the ends of the fabric in accordance with the present invention.
Figure 9:
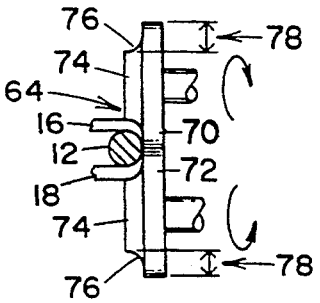
FIG. 9 illustrates a rotary device for further preparing the fabric edge in accordance with the present invention.

As noted previously, it is highly desirable to establish the bonds 20 and 22 as shown in FIG. 1. While it is expected that the majority of such bonds will be formed as a result of the cutting operation, it has been concluded that the bond should not be left to chance. Accordingly, the true cut edge 64 is subjected to a further bonding step. There are two approaches to this bonding step. The first approach is depicted in FIG. 9. In FIG. 9, two oppositely turning rollers, 70 and 72, are applied against the true cut 64 of the fabric. Each of the rollers is heated and is particularly configured to the geometry of the fabric. The rollers 70 and 72 have base portions which meet and form a planar surface against which the true edge 64 is abutted. Each roller has an interior portion 74 which is on center line with the base but has a radius which is reduced by the distance 78. The distance 78 is substantially equal to one half of the fabric gauge. Extending between the interior portion 74 and the base of the rollers is the curvilinear portion 76. As can be seen from FIG. 9, the rollers 70 and 72 present a continuous interface which maintains the gauge of the fabric and urges the edges of the machine direction yarns 16 and 18 against the side of the cross machine direction yarn 12. This establishes good bonding and a regular true cut edge. With reference to FIG. 10, a second device for accomplishing the preferred bonding is illustrated. With the device shown in FIG. 10, the plates 80 and 82 are heated plates which will permit local application to accomplish the desired bonding. The faces 84 and 86 of the plates are configured to establish the desired geometry for the true edge of the fabric as previously described in connection with FIG. 9. In the embodiment of FIG. 10, the plates 80 and 82 may be separated by vertical movement as a means of allowing the device to be placed in smaller areas or areas where a continuous movement in the cross machine direction is not possible. Accordingly, a device such as that shown in FIG. 10 may be used for insertion into the recesses 32 so as to assure the efficiency of the bond 42, see FIG. 5. It will be understood by those skilled in the art that the size and geometric configuration of the plates 80 and 82 may be altered in light of the fabric construction. In general, the use of a device such as that shown in FIG. 9 is preferred for the true cut. However, if so desired a device of the type shown in FIG. 10 may be progressively moved in the cross machine direction to accomplish a similar result.

With reference to FIG. 12, there is shown a preferred pintle assembly 130. The pintle assembly 130 includes a lead wire 132 which is smaller than the desired pintle 50. The lead wire 132 and the pintle 150 are joined by the conical ferrule 134. As noted previously, insertion of the pintle 50 with the assistance of such a lead wire and ferrule are known in the art. However, it is believed that the configuration as shown in FIG. 12 is particularly desirable in the event that the cross machine direction void 28 has been somehow compressed.

Although a computer guided, laser cutting apparatus has been described, it will be appreciated by those skilled in the art that other cutting devices may be used to prepare the ends of the fabric. The critical consideration in preparing the ends of the fabric is to establish the existence of a true cut along with the bonding areas so as to provide a fabric structure of sufficient strength to permit joining of the ends of the fabric without the need for additional elements while preserving the continuous linear weave construction throughout the joining means.

I claim:

1. An endless papermakers belt formed from a length of woven fabric having two ends, the fabric consists of interwoven machine direction and cross machine direction yarns, the machine direction yarns are woven so that paired upper and lower yarns are stacked in the same relative vertical alignment throughout the body of the fabric, and the ends of the fabric are joined together to form the endless belt, said belt characterized by:

interleaving joining means at each end of the fabric which are formed entirely from the original woven fabric with both the machine and cross machine direction yarns retaining their original woven orientation and position within the fabric, a cross machine direction yarn at least one yarn back from each end is removed to form a void, the void is formed in a complementary position in the projections on each end of the fabric.

2. The belt of claim 1 further characterized in that respective upper and lower yarns in the stacked pairs of machine direction yarns at each end of the fabric are secured to the last respective cross machine direction yarn.

3. The improvement of claim 1 further characterized in that the machine and cross machine direction yarns are thermoplastic, and the respective upper and lower yarns in the stacked pairs of machine direction yarns are secured to a last cross machine direction adjacent to the fabric end by fusion.

4. The belt of claim 1 further characterized in that respective upper and lower yarns in the stacked pairs of machine direction yarns at each end of the fabric are secured to the last respective cross machine direction yarn.

5. The belt of claim 1 further characterized in that the machine direction yarns are thermoplastic and the respective upper and lower yarns in the stacked pairs of machine direction yarns are secured to the last respective cross machine direction yarn by fusion.

* * * * *

UNITED STATES PATENT AND TRADEMARK OFFICE

CERTIFICATE OF CORRECTION

PATENT NO. : 5,366,778

DATED : November 22, 1994

INVENTOR(S) : C. Barry Johnson

It is certified that error appears in the above-identified patent and that said Letters Patent is hereby corrected as shown below:

In claim 3, at column 8, line 51, after "direction", insert --yarn --.

Signed and Sealed this

Fourth Day of April, 1995

Bruce Lehman

*Attest:*

BRUCE LEHMAN

*Attesting Officer*

*Commissioner of Patents and Trademarks*